US005314352A

United States Patent [19]

Halbinger et al.

[11] Patent Number: 5,314,352

[45] Date of Patent: May 24, 1994

[54] STRAIN RELIEF WIRING HOUSING ASSEMBLY

[75] Inventors: Evi Halbinger, Bad Abbach; Herbert Neuberg, Regensburg, both of Fed. Rep. of Germany

[73] Assignee: Siemens Aktiengesellschaft, Munich, Fed. Rep. of Germany

[21] Appl. No.: 895,891

[22] Filed: Jun. 9, 1992

[30] Foreign Application Priority Data

Jun. 11, 1991 [EP] European Pat. Off. ..... 91109526.3

[51] Int. Cl.[5] ..... H01R 13/58; H01R 13/506

[52] U.S. Cl. ..... 439/469; 439/459; 174/65 R

[58] Field of Search ..... 174/65 R, 65 G, 65 SS, 174/135; 439/449, 459, 460, 465, 469

[56] References Cited

U.S. PATENT DOCUMENTS

| | | | |
|---|---|---|---|
| 4,117,998 | 10/1978 | Notoya | 439/459 X |
| 4,444,449 | 4/1984 | Aysta et al. | 439/459 X |
| 4,516,822 | 5/1985 | Wolfel | 439/459 X |
| 4,749,369 | 6/1988 | Wang | 439/459 |
| 4,816,619 | 3/1989 | Heys, Jr. et al. | 174/135 |
| 5,021,610 | 6/1991 | Roberto | 439/469 X |

FOREIGN PATENT DOCUMENTS

| | | | |
|---|---|---|---|
| 102798 | 3/1984 | European Pat. Off. | 439/459 |
| 1178129 | 9/1964 | Fed. Rep. of Germany . | |
| 3842058 | 6/1990 | Fed. Rep. of Germany . | |
| 2575868 | 7/1986 | France . | |
| 2580860 | 10/1986 | France . | |

*Primary Examiner*—Peter Dungba Vo
*Attorney, Agent, or Firm*—Kenyon & Kenyon

[57] ABSTRACT

A wiring housing for use in building services control systems includes a cover for sealing the wire housing. A strain relief device is disposed at a cable entry hole. A molded component having gripping arms is disposed between side walls of the wire housing and forms at least one clamping lip for locking a wire to opposing clamping areas. The wiring housing also includes opposing gripping joint bars of the side walls that are braced by the gripping arms in a clamping plane of the molded components and which grip the gripping joint bars from behind. Guide means are disposed on the molded component and the side walls to secure the molded component to prevent the molded component from tipping.

20 Claims, 3 Drawing Sheets

STRAIN RELIEF WIRING HOUSING ASSEMBLY

BACKGROUND OF THE INVENTION

The present invention relates generally to wiring housings, and more particularly to a wiring housing that is sealed by a cover and which is provided with a strain relief device at a cable entry hole.

Wiring housings, as used for example in connection with circuit-breakers and ground-fault circuit interrupters, or in connection with other units capable of being arranged on mounting rails, are usually attached by rivets or bolts. In the case of wiring housings used for units in building services control systems, one would also like to provide strain relief means for the electric wires to be inserted to relieve the strain exerted on the wires from clamps customarily used in general installation engineering. At the same time, to economize on space and for economic reasons, one would like to use thin housing walls. In this case, however, conventional strain relief devices could not be installed.

The present invention is directed to providing a wiring housing to be sealed by a cover, which has a strain relief device, and which is particularly economical to manufacture and assemble.

SUMMARY OF THE INVENTION

The present invention provides a wiring housing for use in building services control systems that includes a cover for sealing the wire housing. A strain relief device is disposed at a cable entry hole. A molded component having gripping arms is disposed between side walls of the wire housing and forms at least one clamping lip for locking a wire to opposing clamping areas. The wiring housing also includes opposing gripping joint bars of the side walls that are braced by the gripping arms in a clamping plane of the molded components and which grip the gripping joint bars from behind. Guide means are disposed on the molded component and the side walls to secure the molded component to prevent it from tipping.

Accordingly, three functions, namely bracing, locking of a wire, and guidance to prevent tipping, are fulfilled in a complementary manner. As a result of the bracing action, conventional bracing means such as rivets, screw joints or bonding means, are no longer necessary in this area. Moreover, an outward bending of the walls is avoided in the area of the strain-relieving molded component as a result of the strain relief. Clearly, one can also use the molded component for the sole purpose of bracing the housing with its cover, without providing any strain relief. The molded component can then have a correspondingly simpler design.

It is advantageous if the molded component forms gripping edges or gripping nubs on a side, which are accessible from the outside, to facilitate loosening the component by hand. It is also advantageous to configure cut-outs or supporting ribs for hand tools, such as screwdrivers, so that the molded component can be gripped from behind and lifted out.

To provide for a connection, the arms of the molded component, which grip from behind, can be designed in a simple manner as a groove and tongue.

It is also advantageous to configure the guide means on the molded component as a spring arm having a locking hook, which is able to latch behind a nub in the guide means of the wall. This ensures a particularly secure grasp on the molded component.

DETAILED DESCRIPTION

Figure 1:
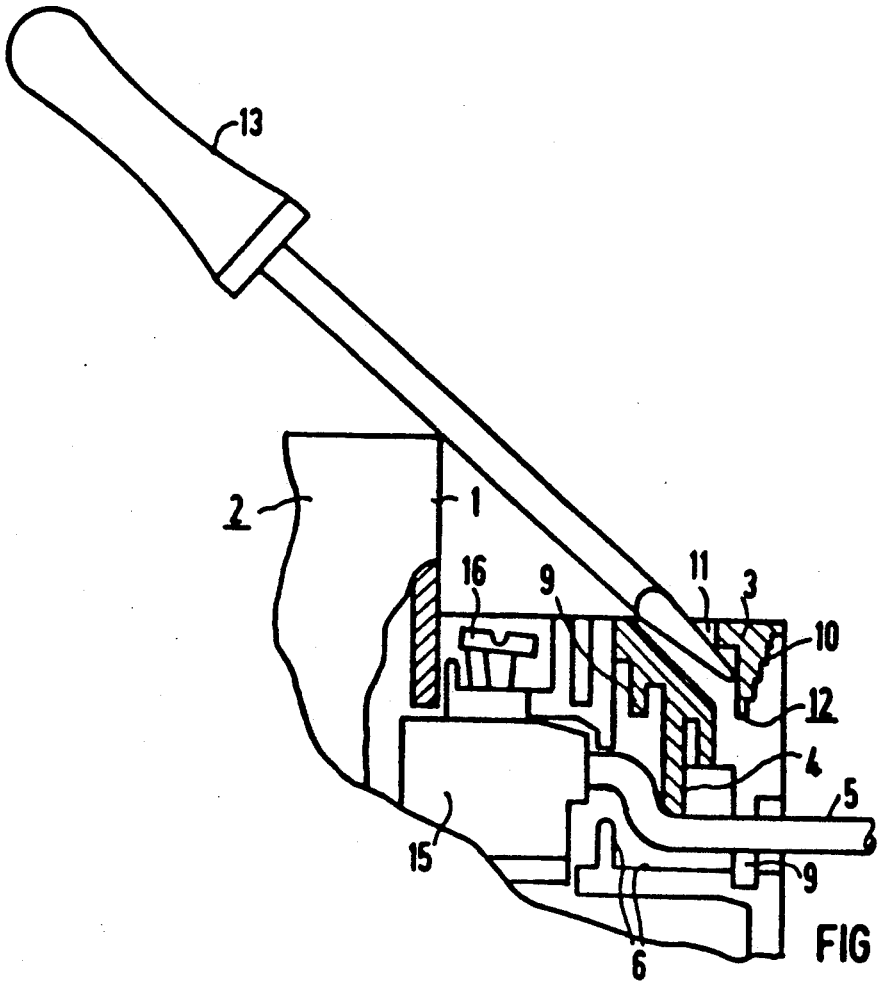
FIG. 1 illustrates a partial, cross-sectional view of a wiring housing and the molded component constructed according to, the principles of the invention.

The wiring housing 1 according to FIG. 1 is sealed by a cover 2. Inserted between the side walls is a molded component 3, which forms a clamping lip 4 for locking a wire 5 to the opposite clamping areas 6. In the embodiment depicted, the molded component 3 has a clamping plane, in which opposing gripping joint bars 7 of the walls are braced by arms 8 of the molded component. The arms 8 grip the gripping joint bars 7 from behind (see FIG. 2). The arms 8 are premolded onto the molded component 3. They engage into U-shaped gripping joint bars 7 so that the molded component 3 braces both the upper lateral wall shown in the Figure and the lower lid. A plane that is vertical relative to the plane of the drawing through the gripping joint bars 7 is defined as a clamping plane. The molded component 3 is secured to prevent it from tipping by guide means 9 on the molded component 3 and walls of the wiring housing (see FIGS. 3 and 6).

Gripping edges 10, which are configured as a series of steps in the embodiment seen in FIG. 1, are disposed on a side of the molded component 3 that is accessible from the outside. Through a cut-out 11, or by using a supporting rib 12, the molded component 3 can be gripped from behind and lifted out by a tool such as a screwdriver 13. The tool may be used as lever by resting the tool on the edges of the housing and lifting out the molded component 3.

To provide for a connection, the arms 8 of the molded component 3, which grip from behind, are designed in the illustrated embodiment in a very simple manner as a groove and tongue, whereby the side walls of the housing, or the cover of the housing, form the U-shaped gripping joint bars 7.

Figure 2:
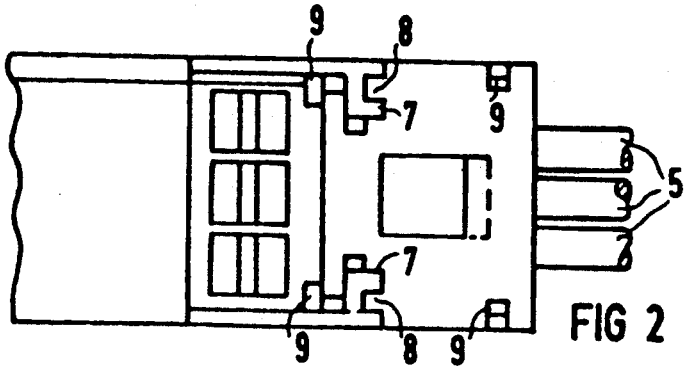
FIG. 2 illustrates a top view of the housing seen in FIG. 1.

As see in FIG. 2, guide means 9 are formed in the molded component 3 and in the housing walls and/or in the lid. The guide means 9 in molded component 3 in the illustrated embodiment are formed from a recess and an engaging rib disposed in the housing wall and/or in the housing lid. Alternatively, the guide means 9 disposed on the molded component 3 are advantageously configured in each case as spring arms having locking hooks 14 that are able to latch behind a nub situated in the guide means in the wall (see FIGS. 3 and 4). The molded component 3 is then secured to prevent it from being pulled off; it can, however, be detached when the spring resistance is overcome.

In the embodiment of the invention seen in FIG. 1, the molded component 3 is seated in front of a clamping member 15 that has clamps for connecting conductors. Screwless clamps are advantageously used, which can be opened by means of opening elements 16.

Figure 3:
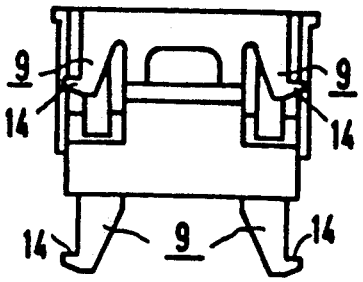
FIG. 3 illustrates a side view of the molded component facing toward the inside of the housing.

As seen in FIG. 3, the guide means 9 that form locking hooks are able to be latched in associated recesses in the guide means 9 of the lateral housing wall and/or the housing lid, if the molded component 3 is designed from a suitable elastic material. FIG. 3 shows that the guide means 9 are arranged on top, relative to its orientation in FIG. 3, and that additional guide means 9 are arranged on the bottom of the molded component 3. In the illustrated embodiment, the lower guide means are longer than the top guide means.

Figure 4:
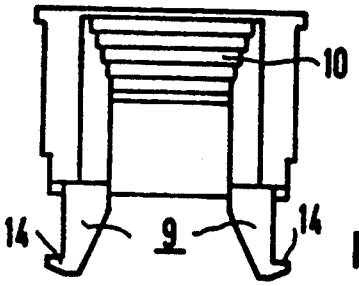
FIG. 4 illustrates the molded component seen in FIG. 3 from the opposite side (i.e., from the front side facing the outside).

In FIG. 4, the longer of the guide means 9 are shown. The molded component 3 forms an inner recess that is pyramidal, and which has step-like gripping edges disposed on the upper side. Locking hooks 14 can be seen on the longer guide means 9.

Figure 5:
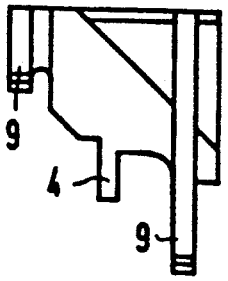
FIG. 5 illustrates another side view of the molded component seen in FIGS. 3 and 4.

FIG. 5 shows a view of the molded component corresponding to that seen in FIG. 1, except that FIG. 5 is a sectional view. FIG. 5 illustrates the lateral configuration of the molded component 3. The shorter guide means 9, seen on the left-hand side, and the longer guide means, seen on the right side, are ribbed in design. A clamping lip 4 can brace a wire 5 against an opposite clamping area 6 (see FIG. 1) by providing traction relief.

Figure 6:
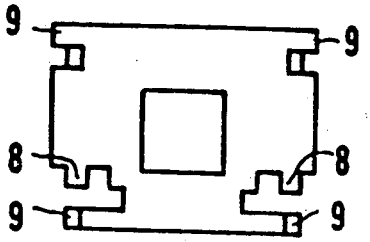
FIG. 6 illustrates the top view of the molded component seen in FIG. 3, which is rotated by 90 degrees relative to the view seen in FIG. 2.

FIG. 6 corresponds to the top view of the molded component seen in FIG. 2 except that it is rotated by 90°. The shorter guide means 9 are shown on top and the longer guide means on the bottom. The arms 8 that grip from behind are able to engage into the gripping joint bars 7 of the housing and/or the lid. In a center portion of the molded component a recess 11 is shown. A tool, such as a screwdriver, for example, may be inserted into the recess to release the molded component 3 from the housing by lifting and/or tilting it out.

Figure 7:
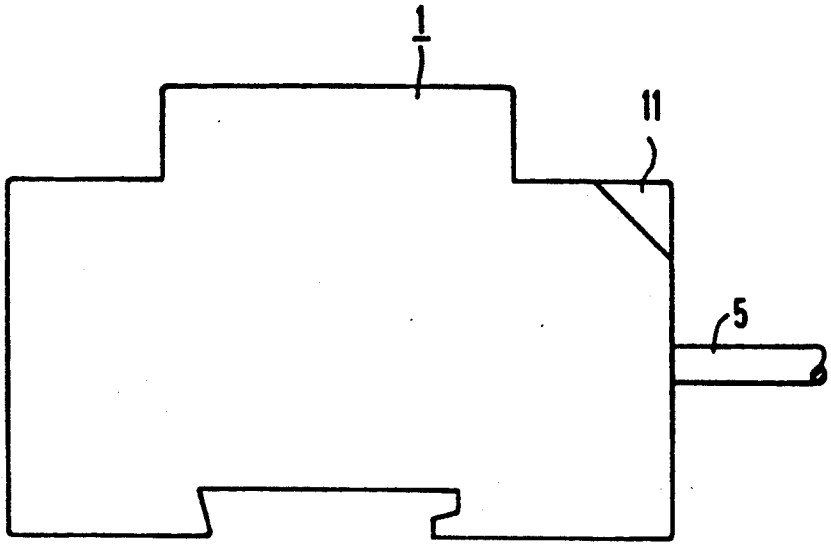
FIG. 7 illustrates a side view of a wiring housing having a molded component.

FIG. 7 shows an installation housing with the molded component in profile. This view corresponds to that of FIG. 1, but in FIG. 7 the installation housing is shown complete and is not shown as a partial sectional view, as in FIG. 1. Apart from that, the proportions in FIG. 7 are reduced in comparison to FIG. 1. The reference line drawn to the recess 11 is to be thought of as being extended by a dotted line into the installation housing.

What is claimed is:

1. A wiring housing assembly for housing a wire, and a coupling thereto, and for use in building services control systems, said wiring housing assembly comprising:

a) a cover sealing a wiring housing, said wiring housing having a wire entry hole and two side walls;

b) a strain relief device disposed at said wire entry hole, said strain relief device including an opposing clamp area;

c) a molded component having a plurality of gripping arms, said molded component being disposed between the side walls of said wiring housing and forming at least one clamping lip for providing strain relief for a wire inserted into said wire entry hole by locking the wire against the opposing clamping area;

d) a plurality of opposing gripping joint bars being disposed on said side walls of said wiring housing, wherein each of said plurality of gripping arms of said molded component bracing each of said plurality of opposing gripping joint bars of said wiring housing in one clamping plane and gripping each of said plurality of opposing gripping joint bars of said wiring housing from behind; and e) a guide element being disposed on said molded component; and f) a corresponding guide element being disposed on said side walls, whereby said guide element and said corresponding guide element interact to secure said molded component to prevent said molded component from tipping.

2. The wiring housing assembly according to claim 1, wherein said molded component further comprises a side piece being accessible from outside the wiring housing and having gripping edges formed thereon.

3. The wiring housing assembly according to claim 1, wherein said molded component further comprises a side piece being accessible from outside the wiring housing and having gripping nubs formed thereon.

4. The wiring housing assembly according to claim 1, wherein the molded component further comprises cut-outs that can be gripped from behind by a handtool to lift out the molded component from the wiring housing.

5. The wiring housing assembly according to claim 4, wherein said molded component further comprises a side piece being accessible from outside the wiring housing and having gripping edges formed thereon.

6. The wiring housing assembly according to claim 4, wherein said molded component further comprises a side piece being accessible from outside the wiring housing and having gripping nubs formed thereon.

7. The wiring housing assembly according to claim 1, wherein the molded component further comprises a plurality of supporting ribs that can be gripped from behind by a handtool to lift out the molded component.

8. The wiring housing assembly according to claim 7, wherein said molded component further comprises a side piece being accessible from outside the wiring housing and having gripping edges formed thereon.

9. The wiring housing assembly according to claim 7, wherein said molded component further comprises a side piece being accessible from outside the wiring housing and having gripping nubs formed thereon.

10. The wiring housing assembly according to claim 1, wherein the plurality of gripping arms of the molded component and the plurality of opposing gripping bars comprise a groove and tongue to provide for a connection.

11. The wiring housing assembly according to claim 10, wherein said molded component further comprises a side piece being accessible from outside the wiring housing and having gripping edges formed thereon.

12. The wiring housing assembly according to claim 10, wherein said molded component further comprises a side piece being accessible from outside the wiring housing and having gripping nubs formed thereon.

13. The wiring housing assembly according to claim 10, wherein the molded component further comprises a plurality of cut-outs that can be gripped from behind by a handtool to lift out the molded component from the wiring housing.

14. The wiring housing assembly according to claim 10, wherein the molded component further comprises a plurality of supporting ribs that can be gripped from behind by a handtool to lift out the molded component.

15. The wiring housing assembly according to claim 1, wherein said corresponding guide element comprises two nubs, one disposed on each of the two walls, and said guide element further comprises two spring arms one on each side, and each spring arm having a locking hook capable of latching behind the nub disposed on the wall on its side.

16. The wiring housing assembly according to claim 15, wherein said molded component further comprises a side piece being accessible from outside the wiring housing and having gripping edges formed thereon.

17. The wiring housing assembly according to claim 15, wherein said molded component further comprises a side piece being accessible from outside the wiring housing and having gripping nubs formed thereon.

18. The wiring housing assembly according to claim 15, wherein the molded component further comprises cut-outs that can be gripped from behind by a handtool to lift out the molded component from the wiring housing.

19. The wiring housing assembly according to claim 15, wherein the molded component further comprises a plurality of supporting ribs that can be gripped from behind by a handtool to lift out the molded component.

20. The wiring housing assembly according to claim 15 wherein the plurality of gripping arms of the molded component and the plurality of opposing gripping bars comprise a groove and tongue for connection there of.

* * * * *